US007390363B2

(12) United States Patent
Fleissner

(10) Patent No.: US 7,390,363 B2
(45) Date of Patent: Jun. 24, 2008

(54) DEVICE FOR APPLYING A HOMOGENEOUSLY THICK LIQUID LAYER OVER THE WORKING WIDTH OF A MATERIAL WEB

(75) Inventor: Gerold Fleissner, Zug (CH)

(73) Assignee: Fleissner GmbH, Egelsbach (DE)

( * ) Notice: Subject to any disclaimer, the term of this patent is extended or adjusted under 35 U.S.C. 154(b) by 255 days.

(21) Appl. No.: 10/535,957

(22) PCT Filed: Nov. 20, 2003

(86) PCT No.: PCT/EP03/50857

§ 371 (c)(1),
(2), (4) Date: Nov. 8, 2005

(87) PCT Pub. No.: WO2004/048671

PCT Pub. Date: Jun. 10, 2004

(65) Prior Publication Data

US 2006/0144328 A1 Jul. 6, 2006

(30) Foreign Application Priority Data

Nov. 22, 2002 (DE) ..... 102 54 793

(51) Int. Cl.
*B05C 5/02* (2006.01)

(52) U.S. Cl. ..... 118/325; 118/DIG. 4; 427/420

(58) Field of Classification Search ..... 68/205 R; 118/325, DIG. 4; 239/553.5; 427/420
See application file for complete search history.

(56) References Cited

U.S. PATENT DOCUMENTS

| | | | | | |
|---|---|---|---|---|---|
| 5,243,841 | A | * | 9/1993 | Fleissner | 68/205 R |
| 5,887,459 | A | * | 3/1999 | Fleissner | 68/205 R |
| 5,913,905 | A | * | 6/1999 | Fleissner | 68/205 R |
| 5,996,154 | A | * | 12/1999 | Fleissner | 8/149 |

FOREIGN PATENT DOCUMENTS

| | | | | |
|---|---|---|---|---|
| DE | 9302905 | | 8/1994 | |
| EP | 0753357 | * | 1/1997 | |
| JP | 3-94865 | * | 4/1991 | 118/325 |

* cited by examiner

*Primary Examiner*—Laura Edwards
(74) *Attorney, Agent, or Firm*—Andrew Wilford

(57) ABSTRACT

A device for applying a liquid as a thin continuous film to a passing workpiece strip has a runoff face and an intake face both extending a full width of the workpiece strip and meeting at an upwardly directed spillover weir. A diverter has a face juxtaposed with the intake face and forming therewith a storage compartment and a lip having a face juxtaposed with the runoff face at the spillover weir. Liquid is fed under pressure to the storage compartment so that the liquid rides up the intake face, over the spillover weir, and down the runoff face to a lower edge thereof whence it drops onto the passing workpiece strip. The lip face blocks any liquid that overshoots the spillover weir and deflects it back onto the runoff face.

8 Claims, 2 Drawing Sheets

3
17
14
13
15
16
11
4
2
9
8
10
12
19
1
1
5
6

DEVICE FOR APPLYING A HOMOGENEOUSLY THICK LIQUID LAYER OVER THE WORKING WIDTH OF A MATERIAL WEB

CROSS REFERENCE TO RELATED APPLICATIONS

This application is the U.S. national phase of PCT application PCT/EP2003/050857 filed 20 Nov. 2003 with a claim to the priority of German patent application 10254793.9 itself filed 22 Nov. 2002, whose entire disclosures are herewith incorporated by reference.

FIELD OF THE INVENTION

The invention relates to a device for applying a wide liquid film in laminar flow in even thickness over its working width to a continuously advancing strip of goods. The device has a liquid reservoir that is restricted on one side by a intake face that is inclined upward at an angle to the horizontal and extends the entire working width, which is followed in the downstream direction by a spillover weir and a runoff face connected thereto, from the bottom edge of which the overflowing liquid film runs off onto the strip of goods, and which is preferably restricted on the other side by an opposing intake face disposed above the first intake face and with a space therebetween. The liquid reservoir has a liquid intake region.

BACKGROUND OF THE INVENTION

A device of such kind is known from U.S. Pat. No. 5,887,459. A characterizing feature of that device is that the liquid is applied evenly to a strip of goods as it advances. This is true initially for any quantity of a paint to be applied. However, it has been shown for larger quantities that with necessarily thick liquid films the pressure from the feed pumps must be so great that the liquid separates from the surface at the spillover weir. The liquid overshoots the spillover weir, and it is no longer possible to apply the liquid evenly over the working width of the runoff face. This problem of constantly increasing kinematics to counter the effective gravity was observed for application quantities between 50 and 200 l/m/min. Of course, it also applies for larger application quantities.

OBJECT OF THE INVENTION

The object of the invention is to improve an application device of the kind described in the introduction so that any volume may be distributed evenly over the working width in a given time unit.

SUMMARY OF THE INVENTION

To attain this object, according to the invention a diverter block extending over the entire working width is attached to the spillover weir or the runoff face to limit the flow rate. The effect of this diverter block is to slow and deflect the liquid rushing over the spillover weir, thus forcing it to run down on the runoff face at a thickness that is predetermined via the adjustable diverter block.

According to above-cited U.S. Pat. No. 5,887,459, a divider comb is arranged inside the liquid reservoir and is designed to have a calming and homogenizing effect on the liquid as it flows over the spillover weir. In conjunction with the diverter block provided according to the present invention, which limits the film thickness of the flow area over the entire working width, it is also advantageous if the free ends of this comb are curved in such manner that they extend over the spillover weir and down onto the runoff face.

BRIEF DESCRIPTION OF THE DRAWING

The drawing is an exemplary illustration of a device according to the invention. In the drawing.

SPECIFIC DESCRIPTION

Figure 1:
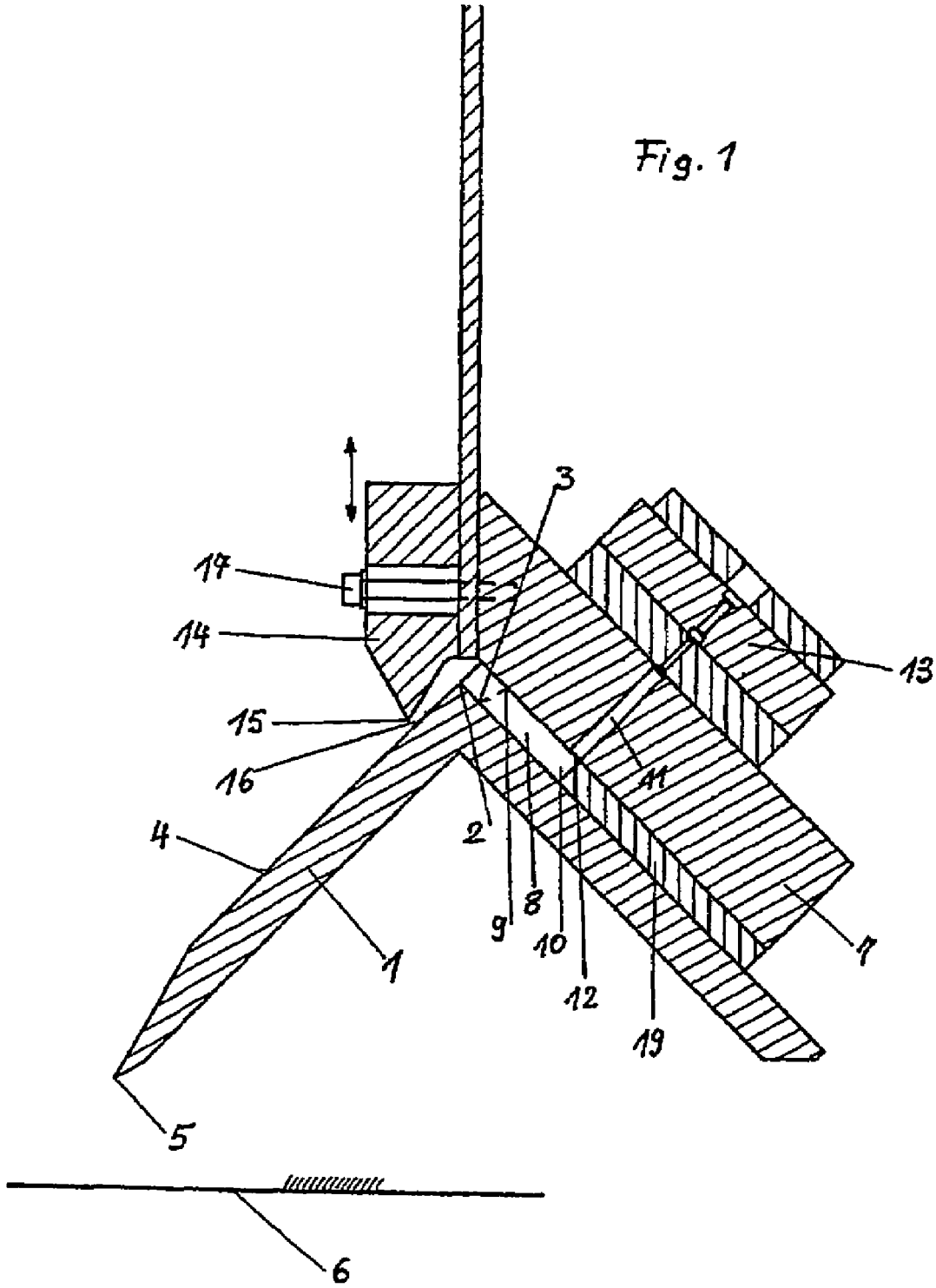
FIG. 1 is a cross-section through the beam of the liquid-application mechanism with the diverter block attached to the beam.

The liquid application device shown in FIG. 1 includes an angle bar 1 forming an upwardly directed spillover weir 2. The leg that is inclined upward toward the spillover weir 2 forms an intake face 3 forming the spillover weir 2 with a runoff face 4. The liquid film or layer for application flows in even distribution over these faces and drops off the bottom edge 5 of runoff face 4 onto the workpiece strip 6.

A solid member 7, the liquid distribution mechanism, is attached in liquid-impermeable manner to the side of bar 1 on the intake face 3 and forms a liquid reservoir 8 adjacent the spillover weir 2. This liquid reservoir 8 is defined on one side by the intake face 3 and oppositely by a face 9 of the liquid distribution element, which is arranged above, parallel to, and at a spacing from the intake face 3.

A liquid collecting space 10 is formed at the end of the liquid reservoir 8 opposite the spillover weir 2. It is fed by a plurality of bores 11 that pass through the liquid distribution mechanism 7, and have liquid inflow apertures 12 at the lower end of the liquid reservoir 8.

A liquid distribution mechanism 13 as described in U.S. Pat. No. 5,243,841 is arranged at the opposite, upper end of bores 11.

It is normally sufficient if the stream of liquid that is pumped through bores 11 flows to spillover weir 2 and from there flows downward over runoff face 4. However, with large application quantities of 50 l/m/min and more there is a risk that the liquid distributed over the working width of the application device may flow so quickly that the kinematics exceed the force of gravity at the spillover weir 2. With such large quantities of liquid, it may happen that the liquid overshoots the spillover weir 2. To prevent this, a liquid diverter block 14 that blocks the overshooting liquid extends the full length of the application device adjacent the spillover weir 2. It has a downwardly projecting lip 15 that forms a flow gap 16 with the runoff face 4. By this means, the advancing volume of liquid is forced to follow the path over the spillover weir 2 collects upstream of the flow gap 16 and then flows with the desired thickness and in the desired volume along the runoff face 4 over the entire width of the application device and onto the goods 6.

Of course, the spacing of the liquid diverter block 14 is adjustable via screws 17 that engage with member 7.

Figure 2:
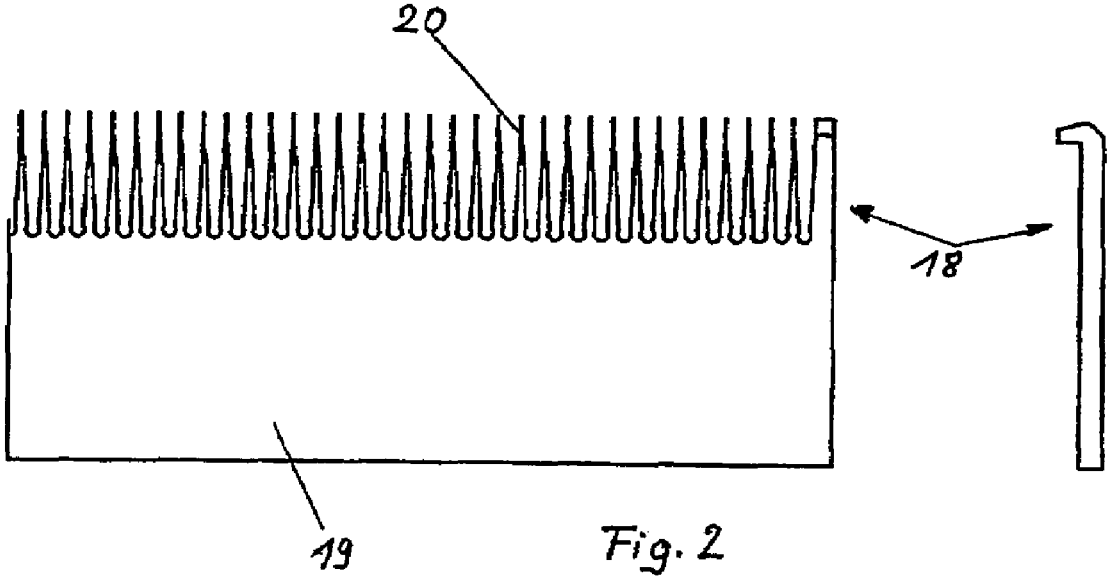
FIG. 2 is a front view and cross-section of a divider comb arranged inside the liquid reservoir and FIG. 3 is a perspective view of the divider comb.
Figure 3:
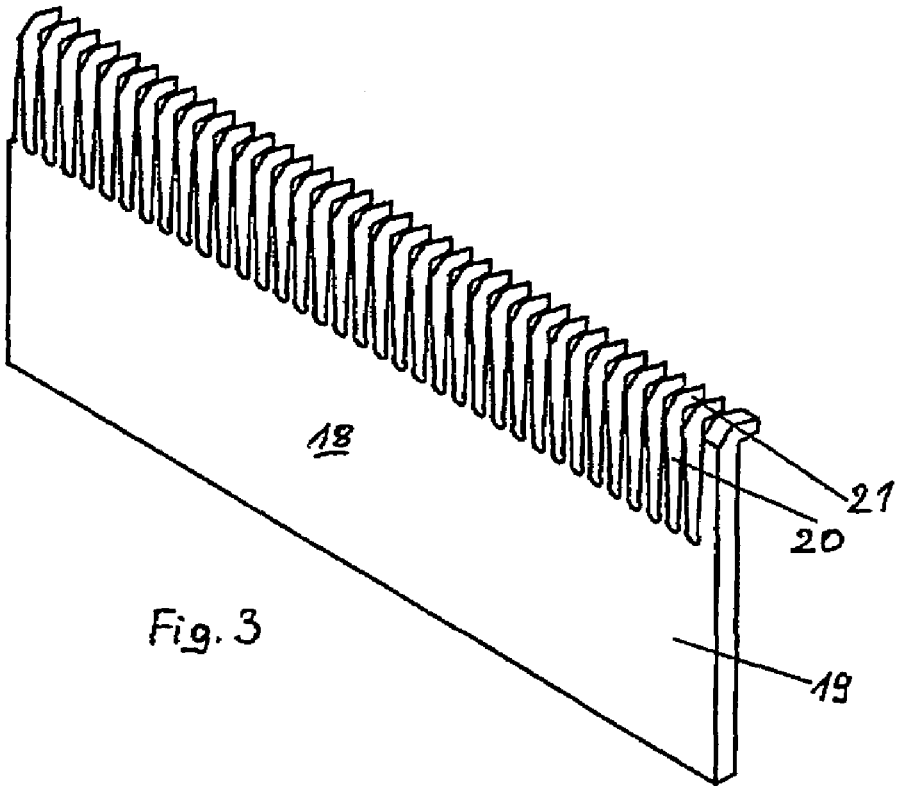

A divider comb 18 is arranged inside the liquid reservoir 8, and a lower mounting rail 19 thereof closes off the bottom the liquid reservoir 8. It is advantageous if the free ends 20 of the teeth of the divider comb 18 are shaped to curve downward as shown in FIGS. 2 and 3. The curves at the ends rest on the spillover weir 2. This curved shape of the comb ends 21 guides the liquid around the spillover weir 2 and assists with the guidance of the application liquid onto the runoff face 4.

The invention claimed is:

1. A device for applying a liquid as a thin continuous film to a passing workpiece strip, the device comprising:

a runoff face and an intake face both extending a full width of the workpiece strip and meeting at an upwardly directed spillover weir;

a diverter having a face juxtaposed with the intake face and forming therewith a storage compartment and a lip having a face juxtaposed with the runoff face at the spillover weir; and means for feeding the liquid to the storage compartment so that the liquid rides up the intake face, over the spillover weir, and down the runoff face to a lower edge thereof whence it drops onto the passing workpiece strip, the lip face blocking any liquid that overshoots the spillover weir.

2. The device as cited in claim 1 wherein the diverter is a block that curves over the spillover weir.

3. The device as cited in claim 1 wherein a height of the lip of the diverter is adjustable for influencing a flow volume alone the runoff face.

4. The device as defined in claim 1 wherein the diverter is a comb having an edge strip forming an upstream end of the storage compartment and a row of teeth extending up along the intake face and over the spillover weir.

5. The device as defined in claim 4 wherein the teeth are L-shaped.

6. The device as defined in claim 1 wherein the faces are planar.

7. A device for applying a liquid as a thin continuous film to a passing workpiece strip, the device comprising:

a runoff face and an intake face both extending a full width of the workpiece strip and meeting at an upwardly directed spillover weir;

a diverter having a face juxtaposed with the intake face and forming therewith a storage compartment;

means including an array of bores opening into the storage compartment for feeding the liquid to the storage compartment so that the liquid rides up the intake face, over the spillover weir, and down the runoff face to a lower edge thereof whence it drops onto the passing workpiece strip; and a comb having a plurality of teeth extending up the intake face and over the weir and having free ends extending down along the runoff face at the spillover weir.

8. The device defined in claim 7 wherein the teeth are L-shaped.

* * * * *